US012808023B2

(12) United States Patent
Eguchi et al.

(10) Patent No.: US 12,808,023 B2
(45) Date of Patent: Nov. 24, 2026

(54) HIGH-STRENGTH SEAMLESS STAINLESS STEEL PIPE FOR OIL WELLS

(71) Applicant: JFE Steel Corporation, Tokyo (JP)

(72) Inventors: Kenichiro Eguchi, Tokyo (JP); Shinsuke Ide, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 247 days.

(21) Appl. No.: 18/712,826

(22) PCT Filed: Dec. 23, 2022

(86) PCT No.: PCT/JP2022/047592

§ 371 (c)(1),
(2) Date: May 23, 2024

(87) PCT Pub. No.: WO2023/145346

PCT Pub. Date: Aug. 3, 2023

(65) Prior Publication Data

US 2025/0003042 A1 Jan. 2, 2025

(30) Foreign Application Priority Data

Jan. 31, 2022 (JP) ..... 2022-013270

(51) Int. Cl.

| | |
|---|---|
| ***C22C 38/60*** | (2006.01) |
| ***C21D 1/18*** | (2006.01) |
| ***C21D 6/00*** | (2006.01) |
| ***C21D 8/10*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/20*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.

CPC ..... *C22C 38/60* (2013.01); *C21D 1/18* (2013.01); *C21D 6/004* (2013.01); *C21D 6/005* (2013.01); *C21D 6/007* (2013.01); *C21D 6/008* (2013.01); *C21D 8/10* (2013.01); *C21D 9/085* (2013.01); *C22C 38/001* (2013.01); *C22C 38/002* (2013.01); *C22C 38/004* (2013.01); *C22C 38/005* (2013.01); *C22C 38/008* (2013.01); *C22C 38/02* (2013.01); *C22C 38/04* (2013.01); *C22C 38/06* (2013.01); *C22C 38/20* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/005* (2013.01); *C21D 2211/008* (2013.01)

(58) Field of Classification Search

CPC ..... C22C 38/60; C22C 38/001; C22C 38/002; C22C 38/004; C22C 38/005; C22C 38/008; C22C 38/02; C22C 38/04; C22C 38/06; C22C 38/20; C22C 38/44; C22C 38/46; C22C 38/48; C22C 38/50; C22C 38/52; C22C 38/54; C22C 38/42; C22C 38/58; C21D 1/18; C21D 6/004; C21D 6/005; C21D 6/007; C21D 6/008; C21D 8/10; C21D 9/085; C21D 2211/005; C21D 2211/008; C21D 1/22; C21D 1/60; C21D 9/08

See application file for complete search history.

(56) References Cited

U.S. PATENT DOCUMENTS 6,464,802 B1 10/2002 Miyata et al.
10,151,012 B2 * 12/2018 Eguchi ..... B21B 19/04
(Continued)

FOREIGN PATENT DOCUMENTS

CN 109563581 A 4/2019
EP 3 456 852 A1 3/2019
(Continued)

OTHER PUBLICATIONS

Extended European Search Report issued Dec. 15, 2025, by the European Patent Office in corresponding European Patent Application No. 22924193.0-1103. (12 pages).
(Continued)

*Primary Examiner* — John A Hevey
(74) *Attorney, Agent, or Firm* — Buchanan Ingersoll & Rooney PC

(57) ABSTRACT

A high-strength seamless stainless steel pipe for oil wells is provided. The steel pipe has a component composition, which contains, in mass %, C: 0.015% or less, Si: 0.05 to 0.50%, Mn: 0.04 to 1.80%, P: 0.030% or less, S: 0.005% or less, Cr: 11.0 to 14.0%, Ni: more than 2.0% and 5.0% or less, Mo: 0.5% or more and less than 1.8%, Al: 0.005 to 0.10%, V: 0.005 to 0.20%, Nb: 0.005 to 0.05%, N: less than 0.015%, and O: 0.010% or less, and in which certain components satisfy a predetermined relational formula, and the remainder is made up of Fe and unavoidable impurities, a sum of an amount of precipitated Nb and an amount of precipitated V is 0.002% or more, a yield strength is 758 MPa or more, $vE_{-60}$ is 20 J or more, and a corrosion rate is 0.125 mm/y or less.

5 Claims, No Drawings

(56) References Cited

U.S. PATENT DOCUMENTS

| | | | | |
|---|---|---|---|---|
| 2011/0132501 | A1 | 6/2011 | Eguchi et al. | |
| 2014/0041770 | A1 | 2/2014 | Hashizume et al. | |
| 2015/0152531 | A1 | 6/2015 | Eguchi et al. | |
| 2016/0215359 | A1 | 7/2016 | Eguchi et al. | |
| 2019/0136337 | A1 | 5/2019 | Eguchi et al. | |
| 2023/0167522 | A1* | 6/2023 | Zhang | C21D 1/18 148/507 |
| 2024/0401722 | A1* | 12/2024 | Nishimura | C21D 9/08 |

FOREIGN PATENT DOCUMENTS

| | | | |
|---|---|---|---|
| EP | 3 845 680 | A1 | 7/2021 |
| JP | 2000226642 | A | 8/2000 |
| JP | 2002241902 | A | 8/2002 |
| JP | 2004238662 | A | 8/2004 |
| JP | 2007-169776 | A | 7/2007 |
| JP | 2008-081793 | A | 4/2008 |
| JP | 2010168646 | A | 8/2010 |
| JP | 2014025145 | A | 2/2014 |
| JP | 2015-161010 | A | 9/2015 |
| JP | 2017-040000 | A | 2/2017 |
| WO | 2017168874 | A1 | 10/2017 |
| WO | 2021206080 | A1 | 10/2021 |
| WO | 2021210564 | A1 | 10/2021 |
| WO | 2021/218932 | A1 | 11/2021 |

OTHER PUBLICATIONS

International Search Report (PCT/ISA/210) with English translation and Written Opinion (PCT/ISA/237) mailed on Mar. 7, 2023, by the Japanese Patent Office as the International Searching Authority for International Application No. PCT/JP2022/047592.

Office Action issued by the U.S. Patent and Trademark Office in the U.S. Appl. No. 14/916,265, mailed May 4, 2018, U.S. Patent and Trademark Office, Alexandria, VA. (14 pages).

Office Action (The First Office Action) issued Aug. 22, 2026, by the State Intellectual Property Office of People's Republic of China in corresponding Chinese Patent Application No. 202280078178.0 and an English translation with Concise explanation of relevance of the Office Action. (16 pages).

* cited by examiner

HIGH-STRENGTH SEAMLESS STAINLESS STEEL PIPE FOR OIL WELLS

CROSS REFERENCE TO RELATED APPLICATIONS

This is the U.S. National Phase application of PCT/JP2022/047592, filed Dec. 23, 2022, which claims priority to Japanese Patent Application No. 2022-013270, filed Jan. 31, 2022, the disclosures of these applications being incorporated herein by reference in their entireties for all purposes.

FIELD OF THE INVENTION

The present invention relates to a high-strength seamless stainless steel pipe for oil wells which is suitably used in crude oil or natural gas oil wells and gas wells (hereinafter simply referred to as "oil wells"), etc. In particular, aspects of the invention relate to a high-strength seamless stainless steel pipe for oil wells having excellent low-temperature toughness and carbon dioxide gas corrosion resistance in an extremely severe corrosive environment containing carbon dioxide gas ($CO_2$) and chloride ions ($Cl^-$) at a high temperature of 150 °C or higher.

BACKGROUND OF THE INVENTION

In recent years, from the viewpoint of a steep rise in crude oil prices and depletion of petroleum resources expected in the near future, the development of deep oil fields, or oil and gas fields in a severe corrosive environment in a so-called sour environment containing hydrogen sulfide, etc., which have been neglected so far, is becoming popular. Such oil and gas fields are generally extremely deep, and their atmosphere is also a severe corrosive environment containing $CO_2$, $Cl^-$, and further $H_2S$ at a high temperature. Steel pipes for oil wells used in such an environment are required to be made of a material having both a desired high strength and excellent corrosion resistance.

Conventionally, a 13Cr martensitic stainless steel pipe has been often used as an oil well pipe to be used for mining in oil and gas fields in an environment containing carbon dioxide gas ($CO_2$), chloride ions ($Cl^-$), etc. Further, recently, the use of improved 13Cr martensitic stainless steel having a component system with a reduced C content and increased Ni, Mo, and other components in 13Cr martensitic stainless steel is also expanding.

In response to such demands, for example, there are techniques of PTLs 1 to 3.

PTL 1 discloses a martensitic stainless steel pipe, which contains, in mass %, C: 0.01 to 0.10%, Cr: 9.0 to 15.0%, Ni: 0.1 to 7.0%, N: 0.005 to 0.1%, Si: 0.05 to 1.0%, Mn: 0.05 to 1.5%, Cu: 0.1 to 5.0%, Mo: 0.1 to 3.0%, V: 0.01 to 0.20%, and Al: 0.0005% to less than 0.05%, with the remainder made up of Fe and impurities, and in which P and S in the impurities are at 0.03% or less and 0.01% or less, respectively, and the ratio of austenite in the structure is 0.3 to 1.3%, and the absolute value of the compressive residual stress in the circumferential direction is 1.0 MPa or less.

PTL 2 discloses a high-strength martensitic stainless steel with improved carbon dioxide gas corrosion resistance, which contains, in mass %, C: 0.08% or less, Si: 1% or less, Mn: 0.1 to 2%, Cr: 7 to 15%, Ni: 0.5 to 7%, Nb: 0.005 to 0.5%, Al: 0.001 to 0.1%, N: 0.001 to 0.05%, P: 0.04% or less, and S: 0.005% or less, with the remainder substantially made up of Fe, and in which the contents of Cr, C, Nb, and Ni satisfy a predetermined relational formula, the cross-sectional steel structure contains chromium nitride with a size of 0.2 um or less at 102 to 108 grains/mm$^2$, and the yield strength is 760 MPa or more.

PTL 3 discloses a seamless martensitic stainless steel pipe for oil well pipes, which has a composition containing, in mass %, C: 0.020% or less, Cr: 10 to 14%, Ni: 3% or less, Nb: 0.03 to 0.2%, and N: 0.05% or less, with the remainder made up of Fe and unavoidable impurities, and further has a structure in which the amount of precipitated Nb is 0.020% or more in terms of Nb, and has both a high strength with a yield strength of 95 ksi or more and low-temperature toughness with a fracture appearance transition temperature vTrs of −40 °C or lower in a Charpy impact test.

PATENT LITERATURE

PTL 1: JP2004-238662A
PTL 2: JP2002-241902A
PTL 3: JP2010-168646A

SUMMARY OF THE INVENTION

With the recent development of oil and gas fields, etc. in a severe corrosive environment, a steel pipe for oil wells has been required to have both a high strength and excellent carbon dioxide gas corrosion resistance even in a severe corrosive environment at a high temperature of 150 °C or higher and containing carbon dioxide gas ($CO_2$) and chloride ions ($Cl^-$). In addition, the development of oil fields in cold regions has been increasing, and excellent low-temperature toughness has also been required.

A seamless steel pipe (steel pipe without seams) used as a steel pipe for oil wells is subjected to severe strain during the production process, and therefore, defects are likely to occur on the surface of the steel pipe during pipe making. In order to prevent this, it has also been required to have excellent hot workability.

However, in the techniques described in PTLs 1 to 3, although the strength is high, excellent carbon dioxide gas corrosion resistance and low-temperature toughness are not sufficient. Specifically, in the technique described in PTL 1, the fracture appearance transition temperature in the Charpy impact test is 0 °C, and also Ni content is low, and therefore, the carbon dioxide gas corrosion resistance is poor. In the technique described in PTL 2, the fracture appearance transition temperature in the Charpy impact test is −10 °C, and also Ni content is low, and therefore, the carbon dioxide gas corrosion resistance is poor. In the technique described in PTL 3, the fracture appearance transition temperature in the Charpy impact test is −40 °C, and also Ni content is low, and therefore, the carbon dioxide gas corrosion resistance is poor.

Therefore, an object according to aspects of the invention is to solve the problems of the prior art and provide a high-strength seamless stainless steel pipe for oil wells, which has a high strength and excellent hot workability, as well as excellent carbon dioxide gas corrosion resistance and low-temperature toughness.

Here, the term "high strength" as used herein shall refer to a case where the yield strength YS is 110 ksi (758 MPa) or more.

In addition, the phrase "having excellent hot workability" as used herein shall refer to a case where a cross-sectional reduction ratio is 70% or more when a round bar test piece with a round bar shape having a parallel part diameter of 10 mm taken from a cast piece (billet) is used and heated to 1250 °C with a Gleeble testing machine, held at the heating temperature for 100 seconds, cooled to 1000 °C at 1 °C/sec, held at 1000 °C for 10 seconds, and thereafter pulled until fracture occurs, and the cross-sectional reduction ratio (%) is measured.

In addition, the phrase "having excellent carbon dioxide gas corrosion resistance" as used herein shall refer to a case where a corrosion rate is 0.125 mm/y or less when a corrosion test piece is immersed in a test liquid: a 20 mass % NaCl aqueous solution (liquid temperature: 150 °C, $CO_2$ gas atmosphere at 10 atm) held in an autoclave by setting an immersion period to 14 days, and also pitting corrosion with a diameter of 0.2 mm or more does not occur when the corrosion test piece after the corrosion test is observed for the presence or absence of occurrence of pitting corrosion on the surface of the corrosion test piece using a loupe with a magnification of 10 times.

In addition, the phrase "having excellent low-temperature toughness" as used herein shall refer to a case where an absorbed energy $vE_{-60}$ in a Charpy impact test (with a V-notch test piece (5 mm in thickness)) at −60 °C is 20 J or more.

Note that each of the above tests can be performed by the methods described in Examples below.

In order to achieve the above object, the present inventors have intensively studied the effects of various component compositions on the carbon dioxide gas corrosion resistance and low-temperature toughness in stainless steel pipes. As a result, it was found that in order to achieve both carbon dioxide gas corrosion resistance and low-temperature toughness in a YS 110 ksi grade (758 MPa to 896 MPa) high-strength material, it is necessary to precipitate appropriate amounts of Nb and V while reducing C and N and adding Cr, Ni, and Mo in appropriate amounts.

Cr, Ni, and Mo form a dense corrosion product on the surface of a steel pipe and reduce the corrosion rate in a carbon dioxide gas environment. On the other hand, C and N combine with Cr and reduce the amount of Cr that effectively acts on the improvement of corrosion resistance. Therefore, in order to have excellent corrosion resistance in a high-temperature carbon dioxide gas environment, it is necessary to appropriately adjust the amounts of Cr, Ni, Mo, C, and N.

Further, in accordance with aspects of the invention, it is necessary to precipitate appropriate amounts of Nb and V. A desired high strength cannot be obtained merely by reducing C and N contents. Therefore, by adding appropriate amounts of Nb and V, carbonitrides of Nb and V are precipitated, which not only contributes to an increase in strength, but also can improve carbon dioxide gas corrosion resistance by reducing C and N contents in a solid solution state. Note that Ti forms coarse TiN and deteriorates the low-temperature toughness value, and therefore cannot be added in accordance with aspects of the invention.

Further, in order to have excellent hot workability, it is necessary to set the δ-ferrite fraction during billet heating to a predetermined value or less. To do so, it is necessary to appropriately adjust the addition amounts of a ferrite-forming element and an austenite-forming element.

Aspects of the invention have been completed by conducting further studies based on these findings, and are as follows.

[1] A high-strength seamless stainless steel pipe for oil wells having a component composition, which contains, in mass %, C: 0.015% or less, Si: 0.05 to 0.50%, Mn: 0.04 to 1.80%, P: 0.030% or less, S: 0.005% or less, Cr: 11.0 to 14.0%, Ni: more than 2.0% and 5.0% or less, Mo: 0.5% or more and less than 1.8%, Al: 0.005 to 0.10%, V: 0.005 to 0.20%, Nb: 0.005 to 0.05%, N: less than 0.015%, and O: 0.010% or less, and in which Cr, Ni, Mo, and C satisfy formula (1) when a value represented by formula (2) is denoted by Neff, and also Cr, Mo, Si, C, Mn, Ni, Cu, and N satisfy formula (3), and the remainder is made up of Fe and unavoidable impurities, wherein a sum of an amount of precipitated Nb and an amount of precipitated V satisfies formula (4), a yield strength is 758 MPa or more, an absorbed energy at −60 °C $vE_{-60}$ is 20 J or more, and a corrosion rate is 0.125 mm/y or less:

$$Cr + 0.2 \times Ni + 0.25 \times Mo - 20 \times C - 3.7 \times Neff \geq 13.25; \quad (1)$$

$$Neff = N - 14 \times (V/50.94 + Nb/92.91); \quad (2)$$

$$Cr + Mo + 0.3 + Si - 43.3 \times C - 0.4 \times Mn - Ni - 0.3 \times Cu - 9 \times N \leq 11.0; \quad (3)$$

and $$\text{the amount of precipitated Nb} + \text{the amount of precipitated V} \geq 0.002, \quad (4)$$

wherein Cr, Ni, Mo, Cu, C, Si, Mn, N, V, and Nb in formulae (1) to (3) denote the contents (mass %) of respective elements, and the content of an element which is not contained is determined to be 0, and the amount of precipitated Nb and the amount of precipitated V in formula (4) are a total precipitation amount (mass %) of Nb and V precipitated as precipitates, provided that when Neff in formula (2) is a negative value, Neff in formula (1) is determined to be 0.

[2] The high-strength seamless stainless steel pipe for oil wells according to [1], containing one group or two groups selected from the following group A and group B in mass % in addition to the component composition:

group A: one element or two or more elements selected from Cu: 3.0% or less, W: 3.0% or less, and Co: 0.3% or less; and group B: one element or two or more elements selected from Zr: 0.20% or less, B: 0.01% or less, REM: 0.01% or less, Ca: 0.0100% or less, Sn: 0.20% or less, Ta: 0.10% or less, Mg: 0.01% or less, and Sb: 0.50% or less.

According to aspects of the invention, a high-strength seamless stainless steel pipe for oil wells, which has excellent hot workability as well as excellent carbon dioxide gas corrosion resistance and low-temperature toughness, and also has a high strength with a yield strength YS of 758 MPa or more is obtained.

DETAILED DESCRIPTION OF EMBODIMENTS OF THE INVENTION

Hereinafter, embodiments of the invention will be described in detail. Note that the invention is not limited to the following embodiments.

First, the component composition of the high-strength seamless stainless steel pipe for oil wells according to aspects of the invention, and the reason for the limitation of the component composition will be described. Hereinafter, unless otherwise specified, mass % is simply denoted by "%".

C: 0.015% or Less

C forms a Cr carbide and deteriorates carbon dioxide gas corrosion resistance. Therefore, it is necessary to set the C content to 0.015% or less. Although the lower limit of the C content is not set, the reduction of the C content to less than 0.003% leads to a steep rise in production cost. Therefore, in accordance with aspects of the invention, the C content is preferably set to 0.003% or more. The C content is set to preferably 0.012% or less, more preferably 0.010% or less.

Si: 0.05 to 0.50%

Si is an element that acts as a deoxidizer. This effect is obtained by incorporation of 0.05% or more of Si. On the other hand, incorporation of more than 0.50% of Si deteriorates hot workability and also deteriorates carbon dioxide gas corrosion resistance. Therefore, the Si content is set to 0.05 to 0.50%. The Si content is set to preferably 0.10% or more, more preferably 0.15% or more. The Si content is set to preferably 0.40% or less, more preferably 0.30% or less.

Mn: 0.04 to 1.80%

Mn is an element that suppresses the formation of δ-ferrite during hot working and improves hot workability. In accordance with aspects of the invention, incorporation of 0.04% or more of Mn is needed. On the other hand, excessive incorporation of Mn adversely affects low-temperature toughness and SSC resistance. Therefore, the Mn content is set to 0.04 to 1.80%. The Mn content is set to preferably 0.05% or more, more preferably 0.10% or more. The Mn content is set to preferably 0.80% or less, more preferably 0.50% or less, still more preferably 0.26% or less.

P: 0.030% or Less

P is an element that deteriorates both carbon dioxide gas corrosion resistance and pitting corrosion resistance. In accordance with aspects of the invention, it is preferred to reduce P as much as possible, but an extreme reduction leads to a steep rise in production cost. Therefore, the P content is set to 0.030% or less as a range that is industrially feasible at relatively low cost without causing an extreme decrease in properties. The P content is preferably 0.020% or less. Note that the lower limit of the P content is not particularly limited. However, since an excessive reduction leads to an increase in production cost as described above, the P content is preferably set to 0.005% or more.

S: 0.005% or Less

S significantly deteriorates hot workability and degrades low-temperature toughness due to segregation to prior austenite grain boundaries, and therefore, it is preferred to reduce S as much as possible. When the S content is 0.005% or less, the segregation of S to prior austenite grain boundaries can be suppressed, and the low-temperature toughness aimed at by aspects of the invention can be obtained. Therefore, the S content is set to 0.005% or less. The S content is preferably 0.0015% or less. However, since an excessive reduction leads to an increase in production cost, the S content is preferably set to 0.0005% or more.

Cr: 11.0 to 14.0%

Cr is an element that forms a protective film and contributes to the improvement of carbon dioxide gas corrosion resistance, and in accordance with aspects of the invention, in order to ensure carbon dioxide gas corrosion resistance at a high temperature, incorporation of 11.0% or more of Cr is needed. On the other hand, incorporation of more than 14.0% of Cr makes it easy to generate retained austenite without martensite transformation, thereby deteriorating the stability of the martensite phase and making it impossible to obtain the strength aimed at by aspects of the invention. Therefore, the Cr content is set to 11.0 to 14.0%. The Cr content is set to preferably 11.5% or more, more preferably 12.0% or more. The Cr content is set to preferably 13.5% or less, more preferably 13.0% or less.

Ni: More than 2.0% and 5.0% or Less

Ni is an element that has an effect of strengthening a protective film and improving carbon dioxide gas corrosion resistance. Further, Ni is solid-dissolved to increase the strength of the steel, and at the same time, to greatly improve the low-temperature toughness. Such an effect is obtained by incorporation of more than 2.0% of Ni. In addition, Ni suppresses the formation of a ferrite phase at a high temperature and improves hot workability. On the other hand, incorporation of more than 5.0% of Ni makes it easy to generate retained austenite without martensite transformation, thereby deteriorating the stability of the martensite phase and deteriorating the strength. Along with this, the cost increases. Therefore, the Ni content is set to more than 2.0% and 5.0% or less. The Ni content is preferably set to 3.0% or more. The Ni content is set to preferably 4.9% or less, more preferably 4.8% or less.

Mo: 0.5% or More and Less than 1.8%

Mo is an element that increases resistance to pitting corrosion due to $Cl^-$ or low pH, and in accordance with aspects of the invention, incorporation of 0.5% or more of Mo is needed. Incorporation of less than 0.5% of Mo deteriorates carbon dioxide gas corrosion resistance in a severe corrosive environment. On the other hand, incorporation of 1.8% or more of Mo generates δ-ferrite to lead to deterioration of hot workability and also to increase cost. Therefore, the Mo content is set to 0.5% or more and less than 1.8%. The Mo content is set to preferably 0.7% or more, more preferably 0.8% or more. The Mo content is set to preferably 1.6% or less, more preferably 1.4% or less, still more preferably 1.3% or less.

Al: 0.005 to 0.10%

Al is an element that acts as a deoxidizer. This effect is obtained by incorporation of 0.005% or more of Al. On the other hand, when Al is contained in an amount more than 0.10%, the amount of an oxide becomes too large, which adversely affects low-temperature toughness. Therefore, the Al content is set to 0.005 to 0.10%. The Al content is preferably set to 0.010% or more, and preferably set to 0.03% or less.

V: 0.005 to 0.20%

V is an element that improves the strength of steel by solid solution strengthening and precipitation strengthening. In addition, V also has an effect of improving carbon dioxide gas corrosion resistance by fixing N, which deteriorates carbon dioxide gas corrosion resistance, as a precipitate (i.e., V precipitate). This effect is obtained by incorporation of 0.005% or more of V. On the other hand, even if V is contained in an amount more than 0.20%, the strength becomes excessively high, resulting in a decrease in low-temperature toughness. Therefore, the V content is set to 0.005 to 0.20%. The V content is set to preferably 0.05% or more, more preferably 0.07% or more. The V content is set to preferably 0.15% or less, more preferably 0.13% or less.

Nb: 0.005 to 0.05%

Nb is an element that improves the strength of steel by solid solution strengthening and precipitation strengthening. In addition, Nb also has an effect of improving carbon dioxide gas corrosion resistance by fixing N, which deteriorates carbon dioxide gas corrosion resistance, as a precipitate (i.e., Nb precipitate). This effect is obtained by incorporation of 0.005% or more of Nb. On the other hand, even if Nb is contained in an amount more than 0.05%, the strength becomes excessively high, resulting in a decrease in low-temperature toughness. Therefore, the Nb content is set to 0.005 to 0.05%. The Nb content is set to preferably 0.010% or more, more preferably 0.02% or more. The Nb content is more preferably set to 0.04% or less.

N: less than 0.015%

N forms a Cr nitride and deteriorates carbon dioxide gas corrosion resistance. Therefore, the N content is set to less than 0.015%. Although the lower limit of the N content is not set, when the N content is set to less than 0.003%, the production cost will rise significantly. Therefore, the N content is set to preferably 0.003% or more, more preferably 0.005% or more. The N content is set to preferably 0.013% or less, more preferably 0.012% or less, still more preferably 0.010% or less.

O (Oxygen): 0.010% or Less

O (oxygen) is present as an oxide in steel and adversely affects various properties. Therefore, it is desirable to reduce 0 as much as possible. In particular, when the O content exceeds 0.010%, both hot workability and low-temperature toughness significantly deteriorate. Therefore, the O content is set to 0.010% or less. The O content is preferably 0.006% or less, more preferably 0.004% or less. Since an excessive reduction leads to an increase in production cost, the O content is preferably set to 0.0005% or more.

Further, in accordance with aspects of the invention, when a value represented by formula (2) is denoted by Neff, Cr, Ni, Mo, C, N, V, and Nb are contained so as to fall within the above-mentioned ranges and to satisfy the following formula (1).

$$\mathrm{Cr} + 0.2 \times \mathrm{Ni} + 0.25 \times \mathrm{Mo} - 20 \times \mathrm{C} - 3.7 \times \mathit{Neff} \geq 13.25 \quad (1)$$

$$\mathit{Neff} = \mathrm{N} - 14 \times (\mathrm{V}/50.94 + \mathrm{Nb}/92.91) \quad (2)$$

Here, Cr, Ni, Mo, C, N, V, and Nb in formulae (1) and (2) denote the contents (mass %) of respective elements, and the content of an element which is not contained is determined to be 0. Provided that when Neff in formula (2) is a negative value, Neff in formula (1) is determined to be 0.

When the left side value of formula (1) (the value of "Cr+0.2×Ni+0.25×Mo−20×C−3.7×Neff") is less than 13.25, the carbon dioxide gas corrosion resistance in a high-temperature corrosion environment at a high temperature of 150 °C or higher and containing $CO_2$ and $Cl^-$ deteriorates. The reason for this is that the formation of a protective corrosion product containing Cr, Ni, and Mo as main components is insufficient. Therefore, in accordance with aspects of the invention, Cr, Ni, Mo, and C are contained so as to satisfy formula (1). The left side value of formula (1) is preferably set to 13.35 or more. Note that the upper limit of the left side value of formula (1) is not particularly set. From the viewpoint of suppressing the increase in cost and suppressing the decrease in strength due to excessive alloy addition, the left side value of formula (1) is set to preferably 14.0 or less, more preferably 13.8 or less.

Further, in accordance with aspects of the invention, Cr, Mo, Si, C, Mn, Ni, Cu, and N are contained so as to satisfy the following formula (3).

$$\mathrm{Cr} + \mathrm{Mo} + 0.3 + \mathrm{Si} - 43.3 \times \mathrm{C} - 0.4 \times \mathrm{Mn} - \mathrm{Ni} - 0.3 \times \mathrm{Cu} - 9 \times \mathrm{N} \leq 11.0 \quad (3)$$

Here, Cr, Mo, Si, C, Mn, Ni, Cu, and N in formula (3) denote the contents (mass %) of respective elements, and the content of an element which is not contained is determined to be 0.

When the left side value of formula (3) (the value of "Cr+Mo+0.3×Si−43.3×C−0.4×Mn−Ni−0.3χCu−9×N") exceeds 11.0, hot workability necessary and sufficient for making a seamless stainless steel pipe cannot be obtained, and the manufacturability of a steel pipe deteriorates. Therefore, in accordance with aspects of the invention, Cr, Mo, Si, C, Mn, Ni, Cu, and N are contained so as to satisfy formula (3). The left side value of formula (3) is preferably set to 10.0 or less. Note that the lower limit of the left side value of formula (3) is not particularly set. Since the effect is saturated, the left side value of formula (3) is preferably set to 5 or more.

In accordance with aspects of the invention, the remainder other than the components described above is made up of iron (Fe) and unavoidable impurities.

The components described above are basic components. The high-strength seamless stainless steel pipe for oil wells according to aspects of the invention can obtain the desired properties by having these basic components and satisfying all the above formulae (1) to (3).

Further, in accordance with aspects of the invention, as described above, it is necessary to precipitate appropriate amounts of Nb and V while reducing C and N and adding Cr, Ni, and Mo in appropriate amounts. This is because by adding appropriate amounts of Nb and V, carbonitrides of Nb and V are precipitated, which not only contributes to an increase in strength, but also can improve carbon dioxide gas corrosion resistance by reducing C and N in a solid solution state. Therefore, precipitated Nb and precipitated V in the seamless stainless steel pipe are contained so as to satisfy the following formula (4).

$$\text{the amount of precipitated Nb} + \text{the amount of precipitated V} \geq 0.002 \quad (4)$$

Here, the amount of precipitated Nb and the amount of precipitated V in formula (4) are the total precipitation amount (mass %) of Nb and V precipitated as precipitates in the steel determined by the electrolytic extraction residual method described in Examples below. Note that the amount of an element which is not precipitated is determined to be 0.

When the left side value of formula (4) (i.e., the value of "the amount of precipitated Nb+the amount of precipitated V") is less than 0.002%, the precipitation amount is insufficient, and the effect of pinning dislocations and the effect of fixing C or N by a Nb carbonitride or a V carbonitride cannot be obtained, and a high strength aimed at by aspects of the invention cannot be obtained. The left side value of formula (4) is preferably set to 0.004% or more. Note that the upper limit of the left side value of formula (4) is not particularly set. From the viewpoint of preventing deterioration of low-temperature toughness due to an excessive increase in YS, the sum of the amount of precipitated Nb and the amount of precipitated V is set to preferably 0.010% or less, more preferably 0.007% or less.

Further, in accordance with aspects of the invention, in addition to the basic components described above, the following optional elements can be contained as needed for the purpose of further improving the strength, low-temperature toughness, etc. Each of the following components Cu, W, Co, Zr, B, REM, Ca, Sn, Ta, Mg, and Sb can be contained as needed, and therefore, these components may be at 0%.

One element or two or more elements selected from Cu: 3.0% or less, W: 3.0% or less, and Co: 0.3% or less Cu: 3.0% or Less Cu is an element that strengthens a protective film and enhances carbon dioxide gas corrosion resistance, and can be contained as needed. Such an effect is obtained by incorporation of 0.05% or more of Cu. On the other hand, incorporation of more than 3.0% of Cu leads to grain boundary precipitation of CuS and deteriorates hot workability. Therefore, when Cu is contained, the Cu content is preferably set to 3.0% or less. The Cu content is set to preferably 0.05% or more, more preferably 0.5% or more, still more preferably 0.7% or more. The Cu content is set to more preferably 2.5% or less, still more preferably 1.5% or less.

W: 3.0% or Less

W is an element that contributes to an increase in strength and can be contained as needed. Such an effect is obtained by incorporation of 0.05% or more of W. On the other hand, even if W is contained in an amount more than 3.0%, the effect is saturated. Therefore, when W is contained, the W content is preferably set to 3.0% or less. The W content is set to preferably 0.05% or more, more preferably 0.5% or more. The W content is more preferably set to 1.5% or less.

Co: 0.3% or Less

Co is an element that reduces the retained austenite fraction by raising the Ms point and improves strength and SSC resistance. Such an effect is obtained by incorporation of 0.01% or more of Co. On the other hand, when Co is contained in an amount more than 0.3%, the low-temperature toughness value decreases. Therefore, when Co is contained, the Co content is preferably set to 0.3% or less. The Co content is set to preferably 0.01% or more, more preferably 0.05% or more, still more preferably 0.07% or more. The Co content is set to more preferably 0.15% or less, still more preferably 0.09% or less.

One element or two or more elements selected from Zr: 0.20% or less, B: 0.01% or less, REM: 0.01% or less, Ca: 0.0100% or less, Sn: 0.20% or less, Ta: 0.10% or less, Mg: 0.01% or less, and Sb: 0.50% or less Zr: 0.20% or Less Zr is an element that contributes to an increase in strength and can be contained as needed. Such an effect is obtained by incorporation of 0.01% or more of Zr. On the other hand, even if Zr is contained in an amount more than 0.20%, the effect is saturated. Therefore, when Zr is contained, the Zr content is preferably set to 0.20% or less. The Zr content is set to preferably 0.01% or more, more preferably 0.03% or more. The Zr content is set to more preferably 0.10% or less, still more preferably 0.05% or less.

B: 0.01% or Less

B is an element that contributes to an increase in strength and can be contained as needed. Such an effect is obtained by incorporation of 0.0005% or more of B. On the other hand, when B is contained in an amount more than 0.01%, the hot workability deteriorates. Therefore, when B is contained, the B content is preferably set to 0.01% or less. The B content is set to preferably 0.0005% or more, more preferably 0.0007% or more. The B content is more preferably set to 0.005% or less.

REM: 0.01% or Less

REM (rare earth metal) is an element that contributes to the improvement of hot workability and carbon dioxide gas corrosion resistance, and can be contained as needed. Such an effect is obtained by incorporation of 0.0005% or more of REM. On the other hand, even if REM is contained in an amount more than 0.01%, the effect is saturated, and the effect commensurate with the content cannot be expected, which is economically disadvantageous. Therefore, when REM is contained, the REM content is preferably set to 0.01% or less. The REM content is set to preferably 0.0005% or more, more preferably 0.001% or more. The REM content is more preferably set to 0.005% or less.

Ca: 0.0100% or Less

Ca is an element that contributes to the improvement of hot workability, and can be contained as needed. Such an effect is obtained by incorporation of 0.0005% or more of Ca. On the other hand, when Ca is contained in an amount more than 0.0100%, the number density of coarse Ca-based inclusions increases, which makes it impossible to obtain desired low-temperature toughness. Therefore, when Ca is contained, the Ca content is preferably set to 0.0100% or less. The Ca content is set to preferably 0.0005% or more, more preferably 0.0010% or more. The Ca content is more preferably set to 0.0040% or less.

Sn: 0.20% or Less

Sn is an element that contributes to the improvement of carbon dioxide gas corrosion resistance, and can be contained as needed. Such an effect is obtained by incorporation of 0.02% or more of Sn. On the other hand, even if Sn is contained in an amount more than 0.20%, the effect is saturated, and the effect commensurate with the content cannot be expected, which is economically disadvantageous. Therefore, when Sn is contained, the Sn content is preferably set to 0.20% or less. The Sn content is set to preferably 0.02% or more, more preferably 0.04% or more. The Sn content is more preferably set to 0.15% or less.

Ta: 0.10% or Less

Ta is an element that increases the strength. Further, Ta is an element that provides the same effect as Nb, and Nb can be partially replaced with Ta. Such an effect is obtained by incorporation of 0.01% or more of Ta. On the other hand, when Ta is contained in an amount more than 0.10%, the low-temperature toughness deteriorates. Therefore, when Ta is contained, the Ta content is preferably set to 0.10% or less. The Ta content is set to preferably 0.01% or more, more preferably 0.03% or more. The Ta content is more preferably set to 0.08% or less.

Mg: 0.01% or Less

Mg is an element that improves carbon dioxide gas corrosion resistance, and can be contained as needed. Such an effect is obtained by incorporation of 0.002% or more of Mg. On the other hand, even if Mg is contained in an amount more than 0.01%, the effect is saturated, and the effect commensurate with the content cannot be expected. Therefore, when Mg is contained, the Mg content is preferably set to 0.01% or less. The Mg content is set to preferably 0.002% or more, more preferably 0.004% or more. The Mg content is more preferably set to 0.008% or less.

Sb: 0.50% or Less

Sb is an element that contributes to the improvement of carbon dioxide gas corrosion resistance, and can be contained as needed. Such an effect is obtained by incorporation of 0.02% or more of Sb. On the other hand, even if Sb is contained in an amount more than 0.50%, the effect is saturated, and the effect commensurate with the content cannot be expected, which is economically disadvantageous. Therefore, when Sb is contained, the Sb content is preferably set to 0.50% or less. The Sb content is set to preferably 0.02% or more, more preferably 0.04% or more. The Sb content is more preferably set to 0.3% or less.

Next, the steel pipe structure of the high-strength seamless stainless steel pipe for oil wells according to aspects of the invention and the reason for the limitation of the steel pipe structure will be described.

The steel pipe structure of the high-strength seamless stainless steel pipe for oil wells according to aspects of the invention has martensite as a main phase, and contains 10% or less (including 0%) of retained austenite and less than 5% (including 0%) of ferrite.

In order to ensure the strength and carbon dioxide gas corrosion resistance aimed at by aspects of the invention, the steel pipe structure has martensite (i.e., tempered martensite) as the main phase. Here, the "main phase" refers to a structure that accounts for 70% or more in terms of volume ratio to the entire steel pipe. The volume ratio of the martensite is set to preferably 80% or more, more preferably 90% or more. The volume ratio of the martensite may be 100%. The volume ratio of the martensite is preferably set to 95% or less.

Further, the steel pipe structure according to aspects of the invention contains 10% or less of retained austenite in terms of volume ratio to the entire steel pipe. When the volume ratio of the retained austenite increases, the low-temperature toughness is improved. On the other hand, when the volume ratio of the retained austenite exceeds 10%, the strength decreases. Therefore, the volume ratio of the retained austenite is set to 10% or less. The volume ratio of the retained austenite is set to more preferably 8% or less, still more preferably 6% or less. Note that even when the volume ratio of the retained austenite is 0%, the properties aimed at by aspects of the invention can be obtained. The volume ratio of the retained austenite is set to preferably 2% or more, more preferably 4% or more.

Further, in the steel pipe structure according to aspects of the invention, the remainder other than the martensite and the retained austenite is ferrite. From the viewpoint of ensuring hot workability, the volume ratio of the structure of the remainder (i.e., ferrite) is set to less than 5% (including 0%) in terms of volume ratio to the entire steel pipe. The volume ratio of the ferrite is preferably 3% or less.

Each of the above structures can be measured by the following methods.

First, a test piece for structure observation is taken from a central portion of the wall thickness of a cross section orthogonal to the pipe axis direction, and corroded with a Villella's reagent (a reagent obtained by mixing picric acid, hydrochloric acid, and ethanol in proportions of 2 g, 10 ml, and 100 ml, respectively). Then, an image of the structure is taken with a scanning electron microscope (magnification: 1000 times), and by using an image analyzer, the structure fraction (area %) of ferrite is calculated, and this area ratio is treated as the volume ratio %.

Then, a test piece for X-ray diffraction is ground and polished so that the cross section orthogonal to the pipe axis direction (i.e., C cross section) becomes the measurement surface, and the amount of retained austenite (γ) is measured using an X-ray diffraction method. The amount of retained austenite is obtained by measuring the diffraction X-ray integrated intensities of a (220)-plane of γ and a (211)-plane of α (ferrite) and converting them using the following formula.

$$\gamma \text{ (volume ratio)} = 100/(1 + (I\alpha R_\gamma / I_\gamma R\alpha))$$

Here, Iα represents the integrated intensity of α, Rα represents the crystallographic theoretical calculation value of α, Iγ represents the integrated intensity of γ, and Rγ represents the crystallographic theoretical calculation value of γ.

Further, the fraction (volume ratio) of martensite (i.e., tempered martensite) shall be the remainder other than ferrite and retained γ.

Next, a preferred embodiment of a method for producing the high-strength seamless stainless steel pipe for oil wells according to aspects of the invention will be described.

Note that in the following description of the production method, the temperature (° C.) shall be the surface temperature of a steel pipe material and a steel pipe (seamless steel pipe after pipe making) unless otherwise specified. The surface temperature thereof can be measured with a radiation thermometer or the like.

In accordance with aspects of the invention, a steel pipe material having the component composition described above is used as a starting material. The method for producing the steel pipe material, which is the starting material, is not particularly limited. For example, it is preferred that a molten steel having the component composition described above is melted by a melting method such as a converter or a vacuum melting furnace, and then, a steel pipe material (cast piece) such as a billet is formed by a method such as a continuous casting method, an ingot making-billet rolling method, or a hot forging method.

Subsequently, such a steel pipe material is heated (i.e., heating step), and the heated steel pipe material is formed into a hollow raw pipe with a piercing mill using a Mannesmann-plug mill process or a Mannesmann-mandrel mill process, and then hot-worked to make a pipe (i.e., pipe making step). Thereby, a seamless steel pipe having the component composition described above with desired dimensions (predetermined shape) is obtained. The seamless steel pipe may be produced by hot extrusion using a press process in place of the above-mentioned processes.

From the viewpoint of obtaining the steel pipe structure and properties according to aspects of the invention described above, it is desirable to adopt the following production conditions.

For example, in the step of heating the steel pipe material described above, the heating temperature is set to a temperature within the range of 1100 to 1300 °C. When the heating temperature is lower than 1100 °C, the hot workability deteriorates and many defects occur during pipe making. On the other hand, when the heating temperature becomes a high temperature exceeding 1300 °C, the crystal grains become coarse and the low-temperature toughness deteriorates. Therefore, the heating temperature in the heating step is set to a temperature within the range of 1100 to 1300 °C. The heating temperature is preferably set to 1150 °C or higher and preferably set to 1280 °C or lower.

Subsequently, the seamless steel pipe after pipe making is cooled to room temperature at a cooling rate equal to or higher than air cooling. Thereby, a steel pipe structure having martensite as the main phase can be ensured.

Then, subsequent to the cooling, a heat treatment (i.e., a quenching treatment and a tempering treatment) is performed for the seamless steel pipe (steel pipe) after pipe making. Specifically, in the quenching treatment, the steel pipe is reheated to a temperature (i.e., heating temperature) equal to or higher than the $Ac_3$ transformation point, held for a predetermined time, and then cooled at a cooling rate equal to or higher than air cooling so that the surface temperature of the steel pipe reaches a temperature (i.e., cooling stop temperature) equal to or lower than 100 °C This quenching treatment can achieve finer martensite and higher strength.

Note that the heating temperature (i.e., reheating temperature) in the quenching treatment is preferably set to 800 to 950 °C from the viewpoint of preventing coarsening of the structure. Further, from the viewpoint of ensuring thermal uniformity, it is preferred to hold the pipe at the above-mentioned reheating temperature for 5 minutes or more. The holding time is preferably set to 30 minutes or less.

In the cooling in the quenching treatment, when the cooling stop temperature exceeds 100 °C, the amount of retained austenite becomes excessive and the desired strength cannot be obtained. Therefore, the cooling stop temperature is set to 100 °C or lower. The cooling stop temperature is preferably set to 80 °C or lower.

Here, the "cooling rate equal to or higher than air cooling" is 0.01 °C/s or higher.

Subsequently, the steel pipe after being subjected to the above-mentioned quenching treatment is subjected to a tempering treatment. In the tempering treatment, the steel pipe is heated to a temperature (i.e., tempering temperature) of 500 °C or higher and lower than the $Ac_1$ transformation point, held for a predetermined time, and then air cooled. Other cooling such as water cooling, oil cooling, or mist cooling may be performed in place of all or part of the air cooling.

When the tempering temperature becomes a temperature equal to or higher than the $Ac_1$ transformation point, fresh martensite precipitates after tempering, which makes it impossible to ensure the desired high strength. On the other hand, when the tempering temperature becomes lower than 500 °C, the strength becomes excessive, which makes it difficult to ensure the desired low-temperature toughness. Therefore, the tempering temperature is set to 500 °C or higher and lower than the $Ac_1$ transformation point. Thereby, the steel pipe structure becomes a structure having tempered martensite as the main phase, and a seamless steel pipe having a desired strength and desired carbon dioxide gas corrosion resistance is obtained. Note that from the viewpoint of ensuring the thermal uniformity of the material, it is preferred to hold the pipe at the above-mentioned tempering temperature for 10 minutes or more. This holding time is preferably set to 300 minutes or less.

Note that each of the above-mentioned $Ac_3$ transformation point and $Ac_1$ transformation point shall be the actual measurement value read from a change in expansion coefficient (linear expansion coefficient) when a test piece (φ: 3 mm×L (length): 10 mm) is heated at an average heating rate of 15 °C/min and cooled.

Hereinabove, the seamless steel pipe has been described as an example, however, the invention is not limited thereto. It is also possible to produce an electro-resistance-welded steel pipe or a UOE steel pipe using a steel pipe material having the component composition described above, and use it as a steel pipe for oil wells. In this case, when the obtained steel pipe for oil wells is subjected to a quenching treatment and a tempering treatment under the conditions described above, the high-strength seamless stainless steel pipe for oil wells according to aspects of the invention is obtained.

As described above, according to aspects of the invention, an intermediate product (such as a billet) in the middle of producing a product has excellent hot workability, and also a high-strength seamless stainless steel pipe for oil wells that has excellent carbon dioxide gas corrosion resistance and low-temperature toughness, as well as a high strength with a yield strength YS of 758 MPa or more can be obtained.

EXAMPLES

Hereinafter, aspects of the invention will be described based on Examples. Note that the invention is not limited to the following Examples.

Molten steels having a component compositions shown in Table 1 were melted in a vacuum melting furnace and cast pieces were prepared by a hot forging method. The obtained cast pieces were heated at 1250 °C for 1 hour and hot-worked.

Note that "-" in Table 1 indicates that the element was not intentionally added, and includes not only a case where the element was not contained (0%) but also a case where the element was unavoidably contained. A case where the value of Neff determined according to the above formula (2) was a negative value was indicated by zero in "Neff" in Table 1.

A test piece material was cut from the steel material obtained by hot working. Here, the dimensions of the steel material were set as follows: length: 1100 mm, width: 160 mm, and thickness: 15 mm. By using each test piece material, a heat treatment (i.e., a quenching treatment and a tempering treatment) was performed under the conditions shown in Table 2. The quenching treatment and the tempering treatment were performed for the cut test piece material, which may be regarded as the same as the case where the quenching treatment and the tempering treatment are performed for a seamless steel pipe.

Then, evaluation of tensile properties and corrosion properties, evaluation of hot workability, evaluation of low-temperature toughness, and measurement of structure and precipitation amount were performed by the methods described below, respectively.

[Evaluation of Tensile Properties]

A JIS (Japanese Industrial Standards) No. 14A tensile test piece (Φ 6.0 mm) was taken from the test piece material after being subjected to the quenching treatment and the tempering treatment, and a tensile test was performed in accordance with the provisions of JIS Z 2241:2011, and tensile properties (yield strength (YS) and tensile strength (TS)) were determined. Here, those with a yield strength (YS) of 758 MPa or more were evaluated as passed, and those with a yield strength less than 758 MPa were evaluated as failed.

[Evaluation of Corrosion Properties]

A corrosion test piece having the following dimensions: thickness: 3 mm, width: 30 mm, and length: 40 mm was prepared by machining from the test piece material after being subjected to the quenching treatment and the tempering treatment, and a corrosion test was performed.

The corrosion test was performed by immersing the corrosion test piece in a test liquid: a 20 mass % NaCl aqueous solution (liquid temperature: 150 °C, $CO_2$ gas atmosphere at 10 atm) held in an autoclave for an immersion period of 14 days. The weight of the corrosion test piece after the test was measured, and the corrosion rate calculated from the weight loss before and after the corrosion test was obtained. Here, those with a corrosion rate of 0.125 mm/y or less were evaluated as passed, and those with a corrosion rate more than 0.125 mm/y were evaluated as failed.

In addition, the corrosion test piece after the corrosion test was observed for the presence or absence of occurrence of pitting corrosion on the surface of the corrosion test piece using a loupe with a magnification of 10 times. Note that "presence of pitting corrosion" refers to a case where pitting corrosion with a diameter of 0.2 mm or more occurred. "Absence of pitting corrosion" refers to a case where pitting corrosion did not occur, and a case where even if pitting corrosion occurred, it was pitting corrosion with a diameter less than 0.2 mm. Here, those with absence of pitting corrosion (indicated by "absent" in the column of "pitting corrosion" in Table 3) were evaluated as passed, and those with presence of pitting corrosion (indicated by "present" in the column of "pitting corrosion" in Table 3) were evaluated as failed.

In accordance with aspects of the invention, a case where the evaluation based on the corrosion rate and the evaluation based on the presence or absence of occurrence of pitting corrosion were both passed was regarded as having excellent carbon dioxide gas corrosion resistance.

[Evaluation of Hot Workability]

In the evaluation of hot workability, a round bar test piece with a round bar shape having a parallel part diameter of 10 mm taken from a cast piece was used and heated to 1250 °C with a Gleeble testing machine, held at the heating temperature for 100 seconds, cooled to 1000 °C at 1 °C/see, held at 1000 °C for 10 seconds, and thereafter pulled until fracture occurs, and the cross-sectional reduction ratio (%) was measured. Here, a case where the cross-sectional reduction ratio is 70% or more was regarded as having excellent hot workability and evaluated as passed. On the other hand, a case where the cross-sectional reduction ratio is less than 70% was evaluated as failed.

[Evaluation of Low-Temperature Toughness]

In a Charpy impact test, a V-notch test piece (5 mm in thickness) taken so that the longitudinal direction of the test piece was in the rolling direction in accordance with the provisions of JIS Z 2242:2018 was used. The test temperature was set to −60 °C, and the absorbed energy $vE_{-60}$ at −60 °C was obtained, and the low-temperature toughness was evaluated. Three test pieces were used for each, and the arithmetic mean of the obtained values was defined as the absorbed energy (J). Here, a case where the absorbed energy $vE_{-60}$ at −60 °C is 20 J or more was regarded as having excellent low-temperature toughness and evaluated as passed. On the other hand, a case where the absorbed energy $vE_{-60}$ at −60 °C is less than 20 J was evaluated as failed.

[Measurement of Structure]

A test piece for structure observation was prepared from the test piece material after being subjected to the quenching treatment and the tempering treatment, and each structure was measured. The observation plane of the structure was determined to be a cross section perpendicular to the rolling direction (C cross section). First, the test piece for structure observation was corroded with a Villella's reagent (a reagent obtained by mixing picric acid, hydrochloric acid, and ethanol in proportions of 2 g, 10 ml, and 100 ml, respectively), and then, an image of the structure is taken with a scanning electron microscope (magnification: 1000 times), and by using an image analyzer, the structure fraction (vol %) of ferrite was calculated.

Then, a test piece for X-ray diffraction was ground and polished so that the cross section orthogonal to the rolling direction (C cross section) becomes the measurement surface, and the amount of retained austenite (γ) was measured using an X-ray diffraction method. The amount of retained austenite was obtained by measuring the diffraction X-ray integrated intensities of a (220) plane of γ and a (211) plane of α (ferrite) and converting them using the following formula.

$$\gamma \text{ (volume ratio)} = 100/(1 + (I\alpha R_\gamma / I_\gamma R\alpha))$$

Here, Iα represents the integrated intensity of α, Rα represents the crystallographic theoretical calculation value of α, Iγ represents the integrated intensity of γ, and Rγ represents the crystallographic theoretical calculation value of γ.

Further, the fraction (volume ratio) of martensite (i.e., tempered martensite) shall be the remainder other than ferrite and retained austenite.

[Measurement of Precipitation Amount]

A test piece for electrolytic extraction was taken from the test piece material after being subjected to the quenching treatment and the tempering treatment. By using the obtained test piece for electrolytic extraction, electrolytic extraction was performed in a 10% AA (10% acetyl acetone-1% tetramethylammonium chloride-methanol) solution, and the residue (electrolytic residue) remaining after passing through a 0.2 μm filter mesh was obtained. The amount of Nb and the amount of V contained in the obtained electrolytic residue were determined by ICP measurement, and were defined as the amount of precipitated Nb and the amount of precipitated V contained in the sample. Note that in the column of "Precipitate amount" in Table 3, the sum of the measured amount of precipitated Nb and the measured amount of precipitated V is shown.

The obtained results are shown in Table 3.

TABLE 1

| Steel type | Component composition (mass %) | | | | | | | | | |
|---|---|---|---|---|---|---|---|---|---|---|
| No. | C | Si | Mn | P | S | Cr | Ni | Mo | Al | V |
| A | 0.008 | 0.101 | 0.22 | 0.013 | 0.0008 | 12.48 | 4.54 | 0.81 | 0.023 | 0.010 |
| B | 0.009 | 0.130 | 0.21 | 0.016 | 0.0007 | 12.54 | 4.62 | 0.90 | 0.022 | 0.009 |
| C | 0.008 | 0.174 | 0.17 | 0.012 | 0.0010 | 12.57 | 4.64 | 0.86 | 0.029 | 0.053 |
| D | 0.012 | 0.114 | 0.24 | 0.012 | 0.0008 | 12.50 | 4.69 | 0.92 | 0.023 | 0.101 |
| H | 0.006 | 0.118 | 0.25 | 0.021 | 0.0008 | 12.60 | 4.91 | 1.11 | 0.027 | 0.010 |
| H2 | 0.007 | 0.124 | 0.21 | 0.017 | 0.0006 | 12.58 | 4.66 | 0.89 | 0.027 | 0.016 |
| 1 | 0.013 | 0.156 | 0.16 | 0.020 | 0.0008 | 12.44 | 4.59 | 0.84 | 0.024 | 0.018 |
| J | 0.013 | 0.176 | 0.23 | 0.013 | 0.0005 | 12.43 | 4.56 | 0.79 | 0.024 | 0.015 |
| K | 0.011 | 0.200 | 0.20 | 0.016 | 0.0006 | 12.50 | 4.59 | 0.92 | 0.026 | 0.012 |
| L | 0.011 | 0.161 | 0.20 | 0.013 | 0.0007 | 12.60 | 4.66 | 0.91 | 0.022 | 0.013 |
| M | 0.011 | 0.198 | 0.22 | 0.021 | 0.0006 | 12.44 | 4.73 | 0.81 | 0.026 | 0.014 |
| N | 0.005 | 0.134 | 0.21 | 0.015 | 0.0007 | 12.52 | 4.61 | 0.75 | 0.027 | 0.015 |
| 0 | 0.008 | 0.155 | 0.24 | 0.021 | 0.0008 | 12.51 | 4.55 | 0.87 | 0.023 | 0.014 |
| P | 0.007 | 0.165 | 0.20 | 0.018 | 0.0007 | 12.60 | 4.65 | 0.76 | 0.018 | 0.010 |
| Q | 0.012 | 0.201 | 0.23 | 0.015 | 0.0007 | 12.51 | 4.68 | 0.88 | 0.018 | 0.010 |

TABLE 1-continued

| | | | | | | | | | | |
|---|---|---|---|---|---|---|---|---|---|---|
| R | 0.007 | 0.208 | 0.19 | 0.014 | 0.0007 | 12.57 | 4.63 | 0.93 | 0.023 | 0.013 |
| 8 | 0.006 | 0.132 | 0.18 | 0.011 | 0.0008 | 12.37 | 4.71 | 0.75 | 0.013 | 0.016 |
| T | 0.012 | 0.181 | 1.26 | 0.012 | 0.0010 | 10.90 | 1.90 | 0.03 | 0.027 | 0.026 |
| U | 0.019 | 0.170 | 0.24 | 0.017 | 0.0006 | 12.32 | 4.66 | 0.94 | 0.018 | 0.010 |
| V | 0.008 | 0.136 | 0j9 | 0.014 | 0.0007 | 14.26 | 4.65 | 0.86 | 0.026 | 0.018 |
| W | 0.012 | 0.112 | 0.24 | 0.019 | 0.0008 | 12.51 | 5.24 | 0.87 | 0.027 | 0.010 |
| X | 0.007 | 0.106 | 0.24 | 0.015 | 0.0007 | 12.44 | 1.57 | 0.88 | 0.026 | 0.018 |
| Z | 0.005 | 0.183 | 0.24 | 0.013 | 0.0009 | 12.37 | 4.61 | 0.29 | 0.027 | 0.016 |
| AA | 0.007 | 0.155 | 0.23 | 0.009 | 0.0009 | 12.38 | 4.60 | 0.79 | 0.022 | 0.013 |
| AB | 0.010 | 0.191 | 0.24 | 0.014 | 0.0009 | 12.32 | 4.58 | 0.79 | 0.020 | 0.000 |
| AC | 0.007 | 0.116 | 0.22 | 0.012 | 0.0010 | 12.48 | 4.61 | 0.81 | 0.029 | 0.017 |
| AD | 0.011 | 0.069 | 0.90 | 0.018 | 0.0009 | 12.46 | 4.62 | 0.85 | 0.019 | 0.010 |
| AE | 0.009 | 0.106 | 0.22 | 0.011 | 0.0010 | 12.68 | 2.45 | 1.09 | 0.019 | 0.008 |
| AF | 0.004 | 0.105 | 0.22 | 0.009 | 0.0010 | 12.46 | 4.45 | 0.74 | 0.027 | 0.027 |
| AG | 0.009 | 0.150 | 0.18 | 0.012 | 0.0007 | 12.49 | 4.46 | 0.78 | 0.028 | 0.013 |

| | Component composition (mass %) | | | | | | |
|---|---|---|---|---|---|---|---|
| Steel type No. | Nb | N | O | Neff | Left side of formula (1) | Left side of formula (3) | Others |
| A | 0.008 | 0.0102 | 0.0050 | 0.00625 | 13.41 | 8.3 | — |
| B | 0.026 | 0.0133 | 0.0054 | 0.00691 | 13.48 | 8.3 | — |
| C | 0.006 | 0.0116 | 0.0000 | 0.00000 | 13.55 | 8.3 | — |
| D | 0.007 | 0.0089 | 0.0009 | 0.00000 | 13.43 | 8.1 | — |
| H | 0.007 | 0.0075 | 0.0027 | 0.00370 | 13.73 | 8.4 | — |
| H2 | 0.026 | 0.0120 | 0.0044 | 0.00368 | 13.58 | 8.2 | Cu: 0.6 |
| 1 | 0.028 | 0.0127 | 0.0050 | 0.00353 | 13.29 | 8.0 | W: 0.5 |
| J | 0.024 | 0.0146 | 0.0054 | 0.00686 | 13.25 | 7.9 | Co: 0.04 |
| K | 0.028 | 0.0116 | 0.0051 | 0.00408 | 13.41 | 8.2 | Zr: 0.02 |
| L | 0.026 | 0.0090 | 0.0052 | 0.00151 | 13.53 | 8.3 | B: 0.0020 |
| M | 0.024 | 0.0130 | 0.0049 | 0.00554 | 13.35 | 7.9 | REM: 0.006 |
| N | 0.026 | 0.0105 | 0.0054 | 0.00246 | 13.52 | 8.3 | Ca: 0.0020 |
| 0 | 0.024 | 0.0071 | 0.0061 | 0.00000 | 13.48 | 8.4 | Sn: 0.09 |
| P | 0.024 | 0.0138 | 0.0054 | 0.00744 | 13.55 | 8.3 | Ta: 0.05 |
| Q | 0.025 | 0.0069 | 0.0055 | 0.00038 | 13.42 | 8.1 | Mg: 0.0004 |
| R | 0.026 | 0.0116 | 0.0025 | 0.00411 | 13.57 | 8.4 | Sb: 0.10 |
| 8 | 0.002 | 0.0095 | 0.0079 | 0.00480 | 13.36 | 8.0 | — |
| T | 0.038 | 0.0115 | 0.0026 | 0.00000 | 11.05 | 7.9 | Cu: 0.3 |
| U | 0.010 | 0.0122 | 0.0034 | 0.00794 | 13.08 | 7.6 | — |
| V | 0.012 | 0.0136 | 0.0006 | 0.00684 | 15.22 | 10.0 | — |
| W | 0.010 | 0.0149 | 0.0021 | 0.01064 | 13.50 | 7.4 | — |
| X | 0.008 | 0.0098 | 0.0016 | 0.00365 | 12.82 | 11.3 | — |
| Z | 0.012 | 0.0131 | 0.0045 | 0.00689 | 13.24 | 7.7 | — |
| AA | 0.000 | 0.0121 | 0.0010 | 0.00853 | 13.33 | 8.1 | — |
| AB | 0.008 | 0.0148 | 0.0026 | 0.01359 | 13.18 | 7.9 | — |
| AC | 0.006 | 0.0065 | 0.0068 | 0.00092 | 13.46 | 8.3 | Ti: 0.041 |
| AD | 0.006 | 0.0094 | 0.0069 | 0.00575 | 13.36 | 7.8 | — |
| AE | 0.007 | 0.0058 | 0.0074 | 0.00255 | 13.25 | 10.8 | — |
| AF | 0.008 | 0.0073 | 0.0064 | 0.00000 | 13.46 | 8.5 | — |
| AG | 0.045 | 0.0087 | 0.0030 | 0.00000 | 13.40 | 8.3 | — |

*Formula (1): $Cr + 0.2 \times Ni + 0.25 \times Mo - 20 \times C - 3.7 \times Neff \geq 13.25$

*Formula (2): $Neff = N - 14 \times (V/50.94 + Nb/92.91)$

*Formula (3) : $Cr + Mo + 0.3 \times Si - 43.3 \times C - 0.4 \times Mn - Ni - 0.3 \times Cu - 9 \times N \leq 11.0$

TABLE 2

| | | | | Heat treatment | | | | | | |
|---|---|---|---|---|---|---|---|---|---|---|
| | | Transformation point | | Quenching treatment | | | | Tempering treatment | | |
| Steel pipe No. | Steel type No. | $Ac_1$ (°C) | $Ac_3$ (°C) | Heating temperature (°C) | Soaking time (min) | Cooling | Cooling stop temperature (°C) | Tempering temperature (°C) | Soaking time (min) | Cooling |
| 1 | A | 617 | 762 | 925 | 15 | water cooling | 30 | 585 | 20 | air cooling |
| 2 | B | 620 | 764 | 915 | 25 | water cooling | 33 | 585 | 25 | air cooling |
| 3 | C | 624 | 767 | 915 | 20 | water cooling | 24 | 580 | 10 | air cooling |
| 4 | D | 612 | 757 | 920 | 20 | water cooling | 35 | 580 | 25 | air cooling |
| 5 | H | 611 | 754 | 920 | 20 | water cooling | 30 | 585 | 10 | air cooling |
| 6 | H2 | 610 | 764 | 925 | 15 | air cooling | 33 | 585 | 25 | air cooling |
| 7 | 1 | 615 | 762 | 925 | 25 | air cooling | 22 | 590 | 20 | air cooling |
| 8 | J | 612 | 759 | 925 | 25 | water cooling | 21 | 585 | 20 | air cooling |

TABLE 2-continued

| Steel pipe No. | Steel type No. | Transformation point $Ac_1$ (°C) | Transformation point $Ac_3$ (°C) | Heat treatment: Quenching treatment: Heating temperature (°C) | Quenching treatment: Soaking time (min) | Quenching treatment: Cooling | Quenching treatment: Cooling stop temperature (°C) | Tempering treatment: Tempering temperature (°C) | Tempering treatment: Soaking time (min) | Tempering treatment: Cooling |
|---|---|---|---|---|---|---|---|---|---|---|
| 9 | K | 621 | 766 | 920 | 20 | air cooling | 26 | 580 | 20 | air cooling |
| 10 | L | 624 | 767 | 925 | 15 | water cooling | 15 | 585 | 25 | air cooling |
| 11 | M | 605 | 751 | 915 | 25 | air cooling | 23 | 590 | 15 | air cooling |
| 12 | N | 616 | 761 | 920 | 15 | water cooling | 18 | 580 | 25 | air cooling |
| 13 | 0 | 621 | 766 | 925 | 25 | air cooling | 21 | 585 | 20 | air cooling |
| 14 | P | 621 | 764 | 920 | 15 | water cooling | 30 | 590 | 25 | air cooling |
| 15 | Q | 615 | 759 | 915 | 15 | air cooling | 19 | 580 | 20 | air cooling |
| 16 | R | 626 | 769 | 920 | 15 | water cooling | 26 | 590 | 25 | air cooling |
| 17 | 8 | 599 | 747 | 925 | 15 | air cooling | 34 | 590 | 15 | air cooling |
| 18 | T | 665 | 761 | 850 | 20 | air cooling | 25 | 650 | 25 | air cooling |
| 19 | U | 600 | 749 | 925 | 25 | water cooling | 26 | 580 | 15 | air cooling |
| 20 | V | 753 | 859 | 915 | 15 | water cooling | 32 | 590 | 20 | air cooling |
| 21 | W | 598 | 723 | 925 | 25 | water cooling | 27 | 590 | 10 | air cooling |
| 22 | X | 790 | 916 | 925 | 20 | water cooling | 32 | 590 | 20 | air cooling |
| 23 | 7 | 592 | 740 | 925 | 15 | water cooling | 18 | 580 | 10 | air cooling |
| 24 | AA | 606 | 753 | 925 | 20 | water cooling | 32 | 580 | 15 | air cooling |
| 25 | AB | 602 | 751 | 915 | 20 | water cooling | 35 | 590 | 25 | air cooling |
| 26 | AC | 634 | 789 | 915 | 25 | water cooling | 29 | 585 | 20 | air cooling |
| 27 | AD | 587 | 723 | 925 | 15 | water cooling | 30 | 585 | 20 | air cooling |
| 28 | AE | 763 | 904 | 925 | 15 | water cooling | 30 | 585 | 20 | air cooling |
| 29 | AF | 620 | 766 | 925 | 15 | water cooling | 30 | 585 | 20 | air cooling |
| 30 | AG | 625 | 770 | 925 | 15 | water cooling | 30 | 585 | 20 | air cooling |

TABLE 3

| Steel pipe No. | Steel type No. | Hot workability cross-sectional reduction ratio (%) | Retained austenite (vol %) | Martensite (vol %) | Ferrite (vol %) | Precipitate amount (amount of precipitated Nb + amount of precipitated V) (%) | Tensile properties: Yield strength YS (MPa) | Tensile properties: Tensile strength TS (MPa) | Low-temperature toughness $vE_{-60}$ (J) | Corrosion properties: Corrosion rate (mm/y) | Corrosion properties: Pitting corrosion | Remarks |
|---|---|---|---|---|---|---|---|---|---|---|---|---|
| 1 | A | 78 | 0 | 98 | 2 | 0.002 | 843 | 900 | 93 | 0.067 | absent | Inventive Example |
| 2 | B | 79 | 0 | 98 | 2 | 0.005 | 858 | 922 | 94 | 0.045 | absent | Inventive Example |
| 3 | C | 78 | 0 | 98 | 2 | 0.005 | 789 | 833 | 50 | 0.051 | absent | Inventive Example |
| 4 | D | 78 | 0 | 98 | 2 | 0.007 | 822 | 864 | 75 | 0.052 | absent | Inventive Example |
| 5 | H | 78 | 0 | 98 | 2 | 0.002 | 778 | 821 | 123 | 0.024 | absent | Inventive Example |
| 6 | H2 | 75 | 0 | 97 | 3 | 0.006 | 826 | 882 | 102 | 0.051 | absent | Inventive Example |
| 7 | 1 | 78 | 1 | 98 | 1 | 0.005 | 850 | 907 | 100 | 0.053 | absent | Inventive Example |
| 8 | J | 72 | 0 | 96 | 4 | 0.004 | 824 | 879 | 100 | 0.050 | absent | Inventive Example |
| 9 | K | 77 | 0 | 99 | 1 | 0.005 | 824 | 879 | 93 | 0.046 | absent | Inventive Example |
| 10 | L | 80 | 1 | 98 | 1 | 0.004 | 830 | 886 | 98 | 0.045 | absent | Inventive Example |
| 11 | M | 75 | 0 | 98 | 2 | 0.005 | 824 | 879 | 102 | 0.054 | absent | Inventive Example |
| 12 | N | 76 | 0 | 97 | 3 | 0.004 | 847 | 904 | 97 | 0.053 | absent | Inventive Example |
| 13 | 0 | 77 | 2 | 95 | 3 | 0.003 | 823 | 878 | 99 | 0.045 | absent | Inventive Example |
| 14 | P | 72 | 2 | 95 | 3 | 0.004 | 838 | 894 | 104 | 0.052 | absent | Inventive Example |
| 15 | Q | 76 | 0 | 97 | 3 | 0.005 | 847 | 904 | 99 | 0.052 | absent | Inventive Example |
| 16 | R | 80 | 0 | 100 | 0 | 0.006 | 835 | 891 | 109 | 0.048 | absent | Inventive Example |
| 17 | 8 | 74 | 0 | 96 | 4 | 0.001 | 761 | 808 | 97 | 0.129 | absent | Comparative Example |
| 18 | T | 75 | 6 | 92 | 2 | 0.007 | 738 | 823 | 17 | 0.834 | present | Comparative Example |
| 19 | U | 79 | 0 | 99 | 1 | 0.002 | 838 | 894 | 103 | 0.131 | absent | Comparative Example |
| 20 | V | 72 | 13 | 84 | 3 | 0.004 | 738 | 895 | 107 | 0.010 | absent | Comparative Example |
| 21 | W | 76 | 11 | 86 | 3 | 0.002 | 743 | 901 | 101 | 0.049 | absent | Comparative Example |
| 22 | X | 65 | 2 | 91 | 7 | 0.002 | 848 | 905 | 89 | 0.265 | present | Comparative Example |
| 23 | Z | 82 | 1 | 99 | 0 | 0.003 | 850 | 907 | 90 | 0.136 | present | Comparative Example |
| 24 | AA | 75 | 6 | 90 | 4 | 0.001 | 727 | 848 | 103 | 0.134 | absent | Comparative Example |
| 25 | AB | 79 | 6 | 94 | 0 | 0.001 | 731 | 843 | 97 | 0.131 | absent | Comparative Example |
| 26 | AC | 77 | 0 | 97 | 3 | 0.002 | 785 | 825 | 13 | 0.080 | absent | Comparative Example |
| 27 | AD | 75 | 0 | 97 | 3 | 0.002 | 814 | 858 | 23 | 0.072 | absent | Inventive Example |
| 28 | AE | 75 | 1 | 97 | 2 | 0.002 | 798 | 876 | 69 | 0.118 | absent | Inventive Example |
| 29 | AF | 76 | 0 | 97 | 3 | 0.002 | 805 | 842 | 63 | 0.044 | absent | Inventive Example |
| 30 | AG | 80 | 1 | 99 | 0 | 0.002 | 832 | 898 | 90 | 0.061 | absent | Inventive Example |

In all Present Inventive Examples, the yield strength (YS) was 758 MPa or more and the cross-sectional reduction ratio was 70% or more so that the hot workability was excellent, and also the carbon dioxide gas corrosion resistance (corrosion resistance) in a corrosive environment at a high temperature of 150 °C or higher and containing $CO_2$ and $Cl^-$ was excellent, and further the low-temperature toughness was excellent.

On the other hand, in Comparative Examples outside the scope of the invention, a desired value could not be obtained for at least one of the yield strength (YS), hot workability, carbon dioxide gas corrosion resistance, and low-temperature toughness.

The invention claimed is:

1. A high-strength seamless stainless steel pipe for oil wells having a component composition, which comprises, in mass %, C: 0.015% or less, Si: 0.05 to 0.50%, Mn: 0.04 to 1.80%, P: 0.030% or less, S: 0.005% or less, Cr: 11.0 to 14.0%, Ni: more than 2.0% and 5.0% or less, Mo: 0.5% or more and less than 1.8%, Al: 0.005 to 0.10%, V: 0.005 to 0.20%, Nb: 0.005 to 0.05%, N: less than 0.015%, and O: 0.010% or less, and in which Cr, Ni, Mo, and C satisfy formula (1) when a value represented by formula (2) is denoted by Neff, and also Cr, Mo, Si, C, Mn, Ni, Cu, and N satisfy formula (3), and the remainder is made up of Fe and unavoidable impurities, wherein a sum of an amount of precipitated Nb and an amount of precipitated V satisfies formula (4), a yield strength is 758 MPa or more, an absorbed energy at −60 °C $vE_{-60}$ is 20 J or more, and a corrosion rate is 0.125 mm/y or less:

$$Cr + 0.2 \times Ni + 0.25 \times Mo - 20 \times C - 3.7 \times Neff \geq 13.25; \quad (1)$$

$$Neff = N - 14 \times (V/50.94 + Nb/92.91); \quad (2)$$

$$Cr + Mo + 0.3 + Si - 43.3 \times C - 0.4 \times Mn - Ni - 0.3 \times Cu - 9 \times N \leq 11.0; \quad (3)$$

and $$\text{the amount of precipitated Nb} + \text{the amount of precipitated V} \geq 0.002, \quad (4)$$

wherein Cr, Ni, Mo, Cu, C, Si, Mn, N, V, and Nb in formulae (1) to (3) denote the contents (mass %) of respective elements, and the content of an element which is not contained is determined to be 0, and the amount of precipitated Nb and the amount of precipitated V in formula (4) are a total precipitation amount (mass %) of Nb and V precipitated as precipitates, provided that when Neff in formula (2) is a negative value, Neff in formula (1) is determined to be 0.

2. The high-strength seamless stainless steel pipe for oil wells according to claim 1, comprising one group or two groups selected from the following group A and group B in mass % in addition to the component composition:

group A: one element or two or more elements selected from Cu: 3.0% or less, W: 3.0% or less, and Co: 0.3% or less; and group B: one element or two or more elements selected from Zr: 0.20% or less, B: 0.01% or less, REM: 0.01% or less, Ca: 0.0100% or less, Sn: 0.20% or less, Ta: 0.10% or less, Mg: 0.01% or less, and Sb: 0.50% or less.

3. The high-strength seamless stainless steel pipe for oil wells according to claim 1, wherein the component composition comprises Cr: 11.0 to 13.5%.

4. The high-strength seamless stainless steel pipe for oil wells according to claim 1, wherein Cr, Ni, Mo, and C satisfy formula (1):

$$14.0 \geq Cr + 0.2 \times Ni + 0.25 \times Mo - 20 \times C - 3.7 \times Neff \geq 13.25.$$

5. The high-strength seamless stainless steel pipe for oil wells according to claim 1, wherein the component composition comprises Mo: 0.5% or more and 1.4% or less.

* * * * *